US005988190A

United States Patent [19]

Borges

[11] Patent Number: 5,988,190

[45] Date of Patent: Nov. 23, 1999

[54] STRAINER TYPE CLEANER

[76] Inventor: Michael Borges, 19049 Janisse La., Lake Elsinore, Calif. 92530

[21] Appl. No.: 08/926,039

[22] Filed: Sep. 9, 1997

[51] Int. Cl.[6] ..... B08B 3/04

[52] U.S. Cl. ..... 134/117; 134/104.4; 134/135; 206/6.1; 206/205; 210/244; 210/464; 220/23.86; 220/402

[58] Field of Search ..... 134/92, 104.4, 134/110, 117, 135, 182; 68/213; 422/274; 99/413, 295, 306; 210/244, 464, 474; 206/6.1, 205, 207; 220/23.83, 28.86, 400, 402, 408; 366/130

[56] References Cited

U.S. PATENT DOCUMENTS

| | | | |
|---|---|---|---|
| 235,044 | 11/1880 | Thompson | 220/408 X |
| 681,406 | 8/1901 | Chavous | 220/408 X |
| 2,016,550 | 10/1935 | Kirby | 210/244 |
| 3,005,717 | 10/1961 | Pilibos | 220/400 X |
| 3,167,079 | 1/1965 | Weil | 134/135 X |
| 3,894,551 | 7/1975 | Stohlman | 134/117 X |
| 4,765,323 | 8/1988 | Horton | 134/117 X |

FOREIGN PATENT DOCUMENTS

| | | | |
|---|---|---|---|
| 971639 | 8/1950 | France | 210/474 |
| 851406 | 10/1952 | Germany | 99/413 |
| 367472 | 12/1992 | Japan | 206/205 |

*Primary Examiner*—Philip R. Coe
*Attorney, Agent, or Firm*—John B. Dickman, III

[57] ABSTRACT

A cleaning device for cleaning bearings, jewelry, brushes and various parts including a container having a rim, a container seal ledge resting on the container rim forming a fluid seal between the container rim and the container seal lodge, this is a way of supporting a screen a distance from the container bottom including a riser and a cap plug to seal the container while it is being agitated. In one embodiment the riser supports a screen which wedges against the container wall to hold the screen in place. Another embodiment has a frusto conical tube which holds the screen in place.

6 Claims, 3 Drawing Sheets

FIG. 1
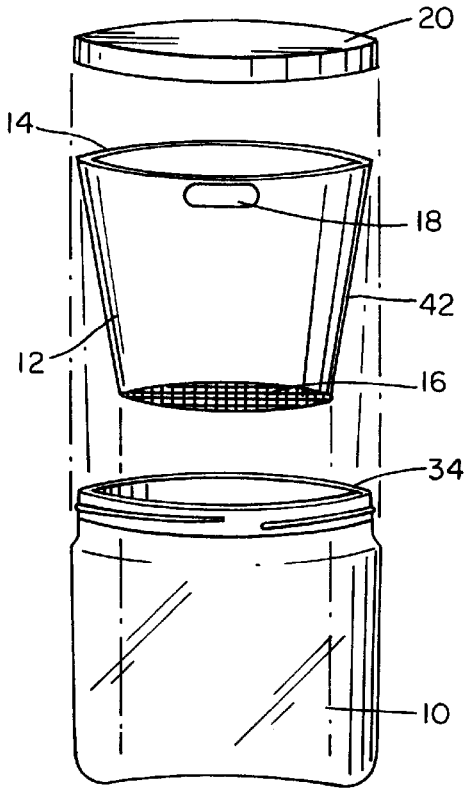
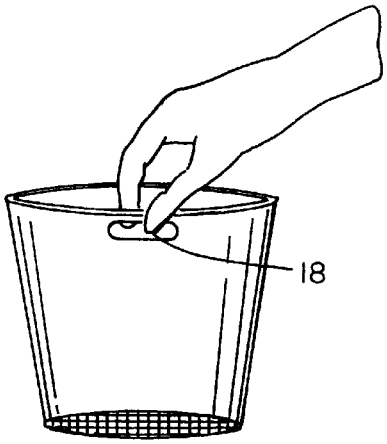
FIG. 2
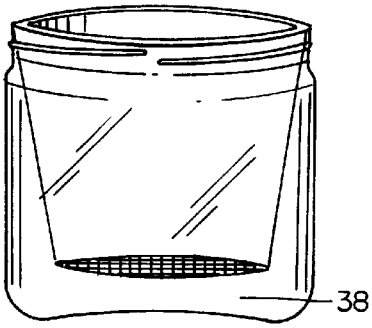
FIG. 3

FIG. 4
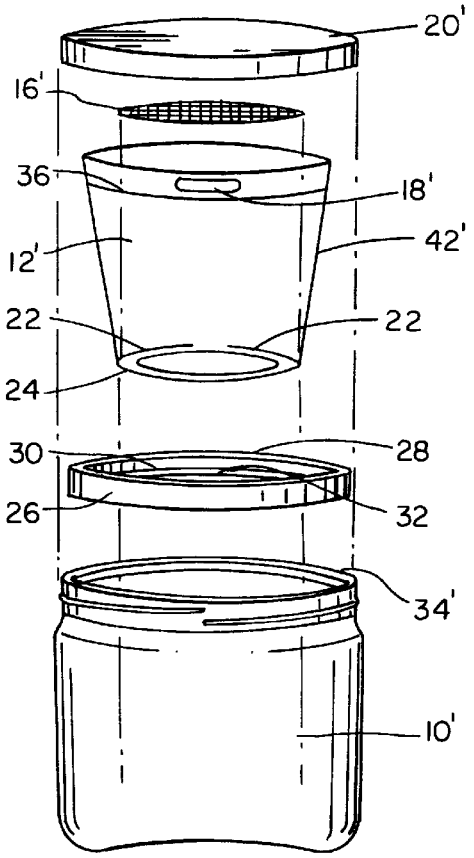
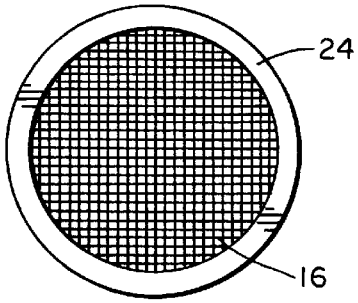
FIG. 5
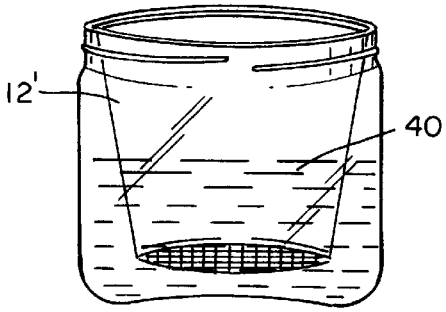
FIG. 6

STRAINER TYPE CLEANER

BACKGROUND OF THE INVENTION

This invention relates to a cleaning system for jewelry, tools and machine parts, and more particularly, a cleaning system with a suspended strainer tub.

Cleaning systems or kits for cleaning jewelry, tools and machine parts are available at various retail stores. Typically, conventional cleaning baskets are supplied along with a container such as a jar or a larger container such as a quart or gallon capacity can, depending on the expected size of the item to be cleaned.

However, it has been determined that the presently available cleaning baskets are awkward to use due to obvious and unobvious flaws and disadvantages. In general, these baskets have low side walls which tend to cause items to be cleaned to spill or fall out of one of these baskets while swishing and/or shaking to clean the contents. Furthermore, where the basked has legs, they are typically short and do not raise the basket off the bottom of a container. This causes the items to be suspended inadequately high enough above any dirt, grease, etc. accumulated on the bottom of the basket. Often the baskets have a handle which extends over the basket or there is a centrally placed stem. The major disadvantage of these handles it that they often block the space needed to conveniently insert or remove the parts cleaned in or out of the basket. Also, the baskets easily tip over to one side or another, especially when made of lightweight plastic materials. Again, this makes it more difficult to keep parts inside and also makes it more awkward to pull a basket out of a container. When a basket tips over in a container, users invariably have to immerse their hands and fingers into dirty fluids in the container to pull out the basket. Hence, because the basket is not anchored and especially if it has low side walls, it is not effective for swishing, shaking or agitating parts for maximum cleaning effectiveness.

The present invention solves all of these problems as well as achieves potential for manufacturing economically via small volume fabrication or higher volume production.

OBJECTS OF THE INVENTION

Accordingly, there are several objects and unobvious advantages of the present invention.

It is an object of the present invention to provide a compactly designed parts cleaning system which is easy to reach from the top of containers such as the likes of a jar, can or bucket.

A further object is to provide a cleaning system with strainer tub that stays firmly in place while swishing, shaking or otherwise agitating parts to be cleaned.

A still further object is to provide a cleaning system with strainer tub that has no extra moving parts such as a retractable handle, the disadvantage being extra cost and greater likelihood of failure or breakage.

Another object is to provide a cleaning system with removable strainer tub where handle is a simple but effective finger hole built-in flush on top side of tub wall.

Another object is to provide a cleaning system with a removable screen for thorough cleaning of strainer tub.

A further object is to provide a cleaning system in which top rim of strainer tub also serves as a sealer between container and container closure to prevent seepage or leaking during cleaning process.

Another object is to provide a cleaning system which is suspended firmly in place in cleaning system container at a level high enough to be above majority of dirt and grease sinking down through screen at bottom of strainer tub.

Another object is to provide a cleaning system with a strainer tub that has no legs attached at bottom, which makes it easier to manufacture as well as quicker and easier to dry parts after being pulled out of container.

SUMMARY OF THE INVENTION

A compact cleaning system for cleaning bearings, jewelry and machine parts. The cleaning system includes a container, a strainer tub with a screen and a container cover arranged in a compact manner to prevent spillage. The strainer tub has a frusto-conical shape and is suspended securely in place in the container when the container cover is tightened. The strainer tub is positioned to hand over the bottom of the container whereby any dirt, sand, grease and grime, etc. pass through the tub and collect on the bottom of the jar.

Another embodiment of the invention provides a riser placed in the bottom of a jar supporting a screen which wedges against the vertical wall of the jar. A cap plug seals the mouth of the jar against spillage, when a screw on cap is screwed on the jar pressing the cap plug against the mouth of the jar.

Another embodiment includes a riser with a screen, a frusto conical tub resting on top of the riser, holding the screen in place and containing parts to be cleaned. A cap plug presses against the frusto conical tub sealing the jar and holding the riser, screen and frusto conical tub in place.

This invention provides a compact and economical system for cleaning a variety of bearings, jewelry and small parts by being able to dip them into a fluid cleaner and easily remove them for drying and/or reassembly. Still further objects and advantages will become apparent from a consideration of the ensuing description and drawings.

DESCRIPTION OF THE DRAWINGS

FIG. 1 shows an exploded view of cleaning system with strainer tub having built-in rim on top serving to suspend tub as well as to provide a container cover seal.

FIG. 2 is a perspective view showing the use of a finger hole to assist in lifting and handling strainer tub unit.

FIG. 3 is a perspective view of the strainer tub hanging from its own rim while resting on top of the jar rim thereby leaving space a the bottom for dirt, grease and grime, etc. to settle.

FIG. 4 shows another embodiment of a strainer tub to be supported by an independent seal rim which press fits into top of jar and rests on top of jar rim.

FIG. 5 shows bottom view of strainer tub variation as shown in FIG. 4.

FIG. 6 shows an assembled view of FIG. 4 without a container cover.

DESCRIPTION OF THE INVENTION

Figure 7:
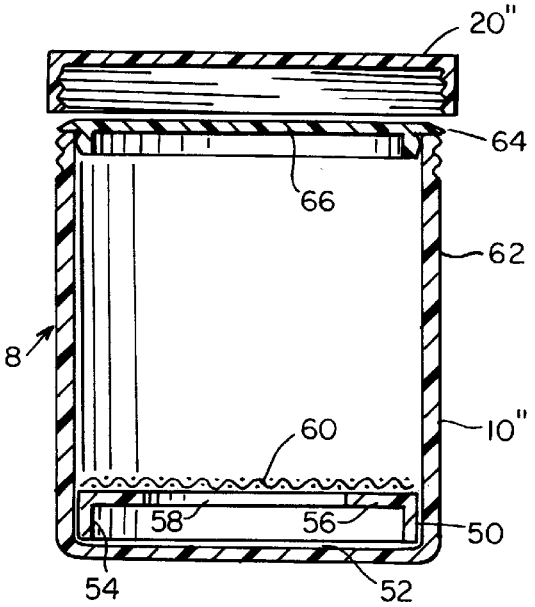
FIG. 7 is a cross section view of another embodiment of the invention showing a riser supporting a screen a distance above the bottom of a jar.

Referring to the drawings FIGS. 1–10, there is shown an embodiment of the invention. Jar 10 is made out of clear plastic suitable to hold an anticipated variety of cleaning fluids for use with cleaning system. A jar rim 34 provides a natural ledge for a strainer tub 12 to rest on tub rim 14. A screen 16 holds parts to be cleaned but allows dirt, sand, grease and grime, etc. to pass through the bottom of jar. There is a screen 16 which may be designed to be removable or as an alternative may also be a permanent part of the strainer tub 12 mold. A finger hole 18 provides a means by which to lift and handle strainer tub 12. Lid 20 is threaded as to fit snugly onto top of jar 10. As a ramification, it is noted here, that lid and jar may be designed to snap together, however, a screw tight container would normally hold most fluids better. All parts shown in FIG. 1 may be made out of a variety of plastics and the jar 10 may also be made of glass, metal or other similar and/or suitable materials.

FIG. 2 shows fingers lifting the strainer tub 12 from finger hole 18. Hole 18 may be shaped in any form convenient to grabbing and/or lifting up the strainer tub unit. Although only one hole is needed, variations of the finger hole may include larger or smaller embodiments as well as a multiplicity of finger holes set about top perimeter of strainer tub. Instead of a finger hole, it is possible to not have one at all, but rather to only use the tub rim 14 as a means for grabbing and lifting strainer tub with finger tips. Although this works quite well, it is better to give the user the benefit of the option to use a finger hole of holes for more effective handling of the strainer tub.

The assembled view of cleaning system shown in FIG. 3 has a debris drop 38 which provides sufficient space for dirt and debris to settle at bottom of cleaning system container. Tub rim 14 fits snugly on top of the jar rim 34 so as to allow lid 20 to properly close the cleaning system in a leak proof manner.

Another embodiment of the invention provides the addition of a seal 26 as part of the complete cleaning system invention. Seal 26 is made of a pliable but tough material such as polyethylene. Seal 26 is designed to be inserted into top inside of jar 10'. The seal contains a seal hole 32 concentrically placed and being large enough to accept insertion of a strainer tub 12 for proper assembly of cleaning system as shown in FIG. 6. The top of strainer tub 12 is flush with the top of seal 26 when completely inserted. This allows for proper closure of lid 20 onto container jar 10 while still being on top to easily reach rim 14 and/or finger hole 18 for ease of removal. A ridge 36 is optional although preferred as it helps strainer tub 12 which is already tapered, to sit more securely on seal ledge 30. The advantage of having a more permanently installed seal such as seal 26, is longevity and assurance of sealing. When strainer tub 12 is inserted and removed from jar 10 repeatedly over a long period of time, the stress and possible exposure to scratching may damage tub rim 14. Therefore, having a separate seal which may permanently reside at the inside top of jar 10' provides better long term control and guarantee of excellent sealing. Furthermore, a strainer tub 12' works completely independent of the improved sealing system while still enabling it to hand from a rim or ledge such as seal ledge 30 from the top of jar 10'. Screen ridge 22 provides a means to snap fit an insertable screen. Thus screen 16' may be sized so as to be easily snapped into position or likewise snapped out for the purpose of more thorough cleaning of screen or to interchange screens with other models of mesh size. Screen ledge 24 is a relatively small percentage of bottom diameter of strainer tub 12'. Screen ledge 24 allows screen 16 to rest on the ledge while screen ridge 22, on inside of bottom cup, helps to keep screen 16' firmly in place while shaking or agitating parts and fluids in use. Seal rim 28 now serves as a fluid tight seal while residing between bottom of jar lid 20 and while protruding slightly over top of jar rim 34' when lid 20 is firmly closed.

FIG. 5 shows the bottom of the strainer cup 12' of FIG. 4. Screen ledge 24 here serves to hold screen 16 in place at bottom of strainer tub 12'. As mentioned earlier, screen 16' may be designed as part of a complete mold; whereby, a user would simply interchange strainer tubs with different screen mesh sizes, or with a removable screen which fits over the screen ledge 24 and extends all the way to the edge of the side wall at the bottom of strainer tub 12'.

In FIG. 6, the assembled view described in FIG. 4 shows the strainer tub 12' resides substantially flush with top seal rim 28 to provide for complete closing of jar lid 20 onto jar 10" while simultaneously allowing for easy reach of finger hole 18' for easy gripping and removal of strainer tub 12' while empty or full with various parts being cleaned. Cleaning fluids 40 suitable for cleaning items are added when strainer tub 12' is submersed into jar 10" with items inside.

The strainer tubs 12 and 12' have a frusto-conical wall 42 and 42', respectively, to support a screen 16 or 16'. Other shapes of strainer tubs and screen are possible, including rectangular shapes, cylindrical shapes and frusto-pyramidal shapes.

A preferred embodiment of the invention is shown in FIG. 7 where jar 10" has a riser 50 positioned on the inside bottom 52 of the jar. The riser 50 has a circular cross section, FIG. 10, and a skirt 54. The riser 50 has a top 56 supported by a skirt 54 a distance above the bottom 52 to keep the articles being cleaned out of any residue in the bottom. There is a hole 58 in the center of top 56 which is covered by a screen 60.

To retain the riser 50 in the bottom of the jar 10", screen 60 is of a diameter to press tightly against the inside of cylindrical wall 62. Cleaning chemicals are placed in the bottom of jar 10'. Articles to be cleaned are placed on top of the screen 60 so that when jar 10" is agitated, the cleaning chemicals remove any tarnish, etc., from the articles.

Figure 8:
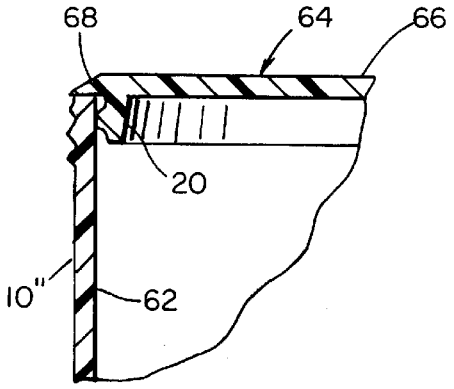
FIG. 8 shows a partial cross section taken along the line 8—8 of FIG. 7 without a jar cap.

In order to prevent the articles or chemicals from splashing out of the jar 10", a cap plug 64 is placed on the mouth of the jar to seal the articles and chemical in. When cap 20" is screwed on the jar, it presses the cap plug 64 against the jar mouth. FIG. 8 shows cap plug 64 having top 66 with a diameter having a lip 68 which extends over the top edge of jar 10". A ring 20 is integral with the bottom side of top 66 and having a diameter to snugly press against the inside of cylindrical wall 62.

Figure 9:
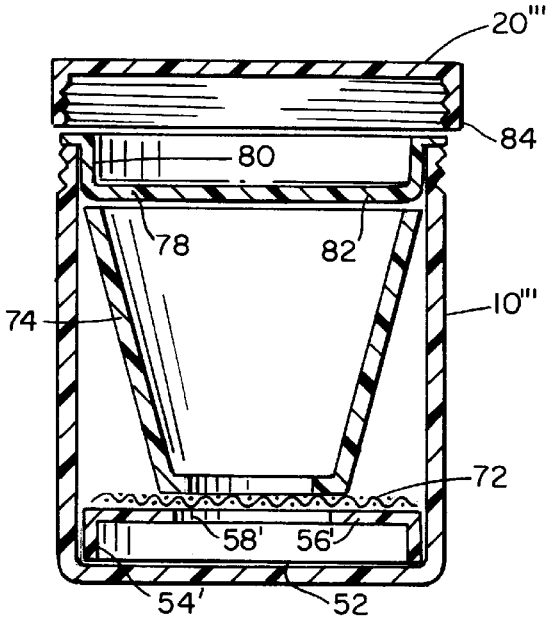
FIG. 9 is still another embodiment of the invention showing a riser supporting a screen above the jar bottom, an inner frusto conical tube supported on the riser with the screen between, and a cap plug pressed against the frusto conical tub.
Figure 10:
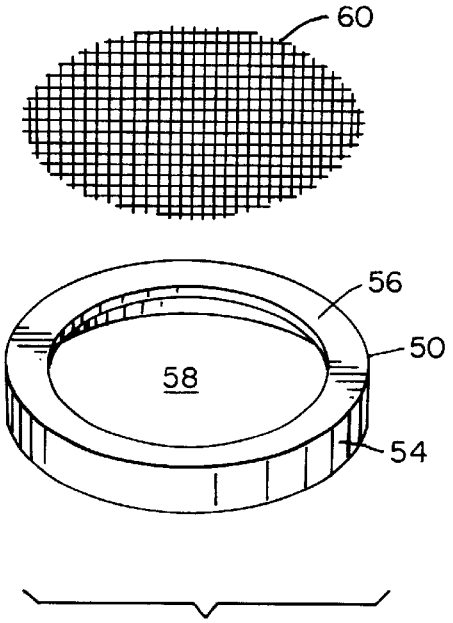
FIG. 10 is a perspective of a riser and screen of said invention.

Another embodiment of the invention is shown in FIG. 9 where riser 54' with a hole 58' in top of 56' rests on the inside bottom of jar 10". A screen 72 is positioned over hole 58' to prevent articles from coming into contact with residue in the bottom of jar 10". A frusto conical tub 74 is place on top of screen 72, holding it in place. Articles for cleaning are placed in the tub so that agitating jar 10" will cause a cleaning chemical in the bottom of the jar to coat the articles, removing any tarnish, etc. The frusto conical shape of tub 74 directs any chemical collected on the inside of the tub to return to the bottom of the jar, passing through hole 58'. An inverted cap plug 78 with a skirt 80 projects into the mouth of jar 10" to press against frusto conical tub 74. There is a bottom 82 which seals the jar against spillage of articles or chemicals. In order to fully seal the jar, skirt 80 has a flange 84 that rests on the top edge of the jar mouth.

In use, the salient feature of each of the embodiments is to provide an article cleaning system where the articles are supported above the bottom of the jar. The frusto conical tubs of FIGS. 1 and 4 and the frusto conical tub of FIG. 9 direct the cleaning chemicals down the inclined wall to the area below the tubs. Whereas, the risers of FIGS. 7 and 9 provide a support for a screen above the bottom of the jar.

Those skilled in the art will envision a variety of other possibilities within the spirit and scope of my invention. The scope of the invention is to be determined by the appended claims and their legal equivalents, examples and ramifications that have been presented within these specifications.

I claim:

1. A cleaning device for bearing, jewelry, brushes and various parts and tools, comprising;

a container having a top rim, side walls and a bottom;

a strainer tub having an open bottom and at least one side wall, where said strainer tub is suspended from said container top rim and is supported above said container bottom;

a strainer screen means supported in said strainer tub at said open bottom;

a cover means for sealing said container, said container has a container seal ledge on said container top rim, where said container seal ledge supports said strainer tub.

2. A cleaning device as in claim 1 wherein said strainer tub has a rim on said at least one side wall of a size to cover the top of said container rim.

3. A cleaning device as in claim 2 wherein said strainer tub has a finger slot in said at least one side wall.

4. A cleaning device as in claim 3 wherein said strainer tub has at least one side wall continuous and tapered.

5. A cleaning device as in claim 4 wherein said strainer tub has a screen supporting ridge at said open bottom.

6. A cleaning device as in claim 5 wherein said strainer screen is removable.

* * * * *